United States Patent [19]

Walter

[11] 4,262,180

[45] Apr. 14, 1981

[54] ALARM SWITCH

[76] Inventor: John W. Walter, 511 Manhasset Woods Rd., Manhasset, N.Y. 11030

[21] Appl. No.: 158,097

[22] Filed: Jun. 10, 1980

[51] Int. Cl.[3] ..... H01H 3/42

[52] U.S. Cl. ..... 200/153 LA; 200/153 T; 200/324; 200/327; 200/332; 340/574

[58] Field of Search ..... 200/153 LA, 153 L, 153 T, 200/157, 332, 329, 68, 325, 330, 324, 44; 340/574

[56] References Cited

U.S. PATENT DOCUMENTS

| | | | |
|---|---|---|---|
| 2,919,333 | 12/1959 | Scholen et al. | 200/153 LA |
| 3,054,869 | 9/1962 | Everett | 200/153 T |
| 3,423,554 | 1/1969 | Acord | 200/153 LA |
| 3,440,635 | 4/1969 | Hull | 340/574 |
| 3,676,625 | 7/1972 | Blatt | 200/153 LA |
| 4,060,704 | 11/1977 | Cole | 200/332 |

*Primary Examiner*—Willis Little

*Attorney, Agent, or Firm*—Allison C. Collard; Thomas M. Galgano

[57] ABSTRACT

An alarm switch includes a hollow casing having a keyhole and a finger opening formed therein, at least one electrical switch mounted in the casing having a spring-loaded actuation pin, a reversible cam pivotably mounted in the casing for movement between a first position, in which it is held in biased engagement with the switch pin so as to maintain the pin in a retracted biased state, and a second release position, in which it is disposed in a substantially non-engaging position with said pin so as to permit extension of said pin and triggering of an alarm signal by the electrical switch, a block slidably mounted in the casing having at least one latch lug which, in a first position of the block, maintains the cam in biased engagement with the switch pin and, in a second position of the block, releases the cam to permit movement to its release position so as to thereby activate the alarm. The cam has a bevelled end face and is removably mounted in said casing to permit mounting thereof with its bevelled end face directed towards or away from the actuation pin. Depending upon the cam disposition, the switch will function as either a momentary or latching switch. Depending on the block position, the switch will function as a finger operated or trip wire operating switch.

11 Claims, 14 Drawing Figures

FIG.6
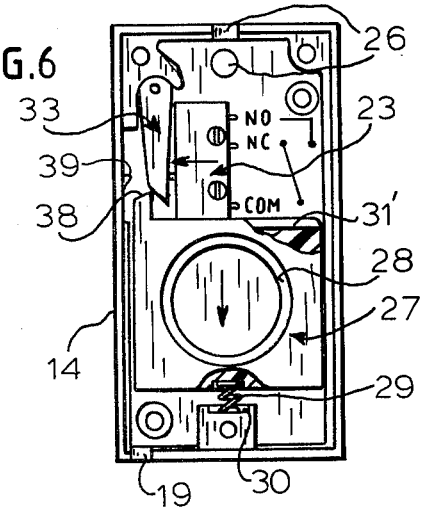
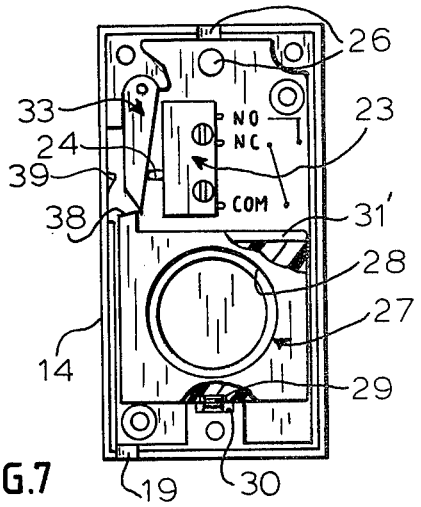
FIG.7
FIG.8
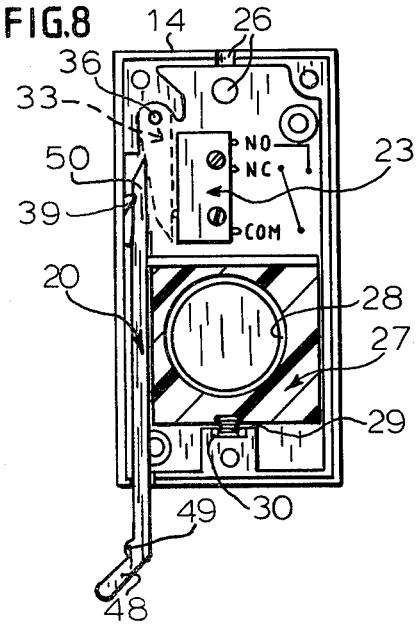
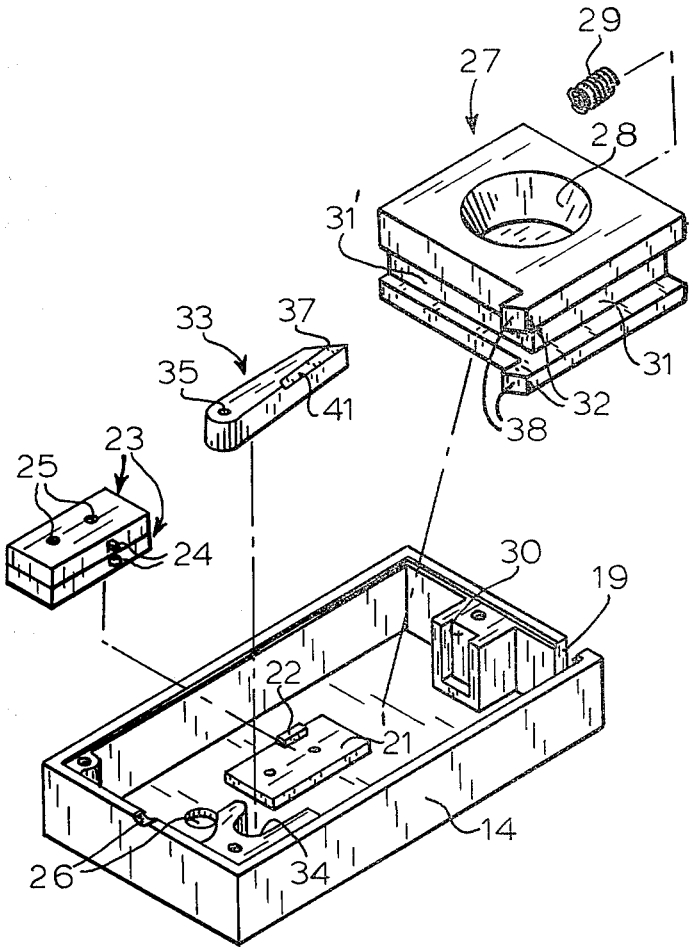
FIG.5

ALARM SWITCH

The present invention relates to an alarm or emergency switch. More particularly, it relates to a burglar, hold-up, and/or security alarm switch.

Pull-type switches for security alarm systems, such as those used in teller cash drawers and other locations in banks are, of course, well known in the art (see, e.g., U.S. Pat. No. 3,054,869, as well as U.S. Pat. Nos. 2,133,545; 3,524,955; 2,756,306; 3,521,013; 4,145,590; and 3,501,599). While generally satisfactory, they have been found to have certain drawbacks. For instance, some are very noisy and others have relatively complicated constructions and are cumbersome to install and use. Moreover, many do not allow for a recessed mounting, such as within a wall or outlet box behind a wall switch plate or the like. Furthermore, most are neither conveniently adaptable to different methods of activation nor readily adaptable for facile conversion between a latching-type switch and a momentary-type switch. Consequently, installers must carry a wide variety of switches for different applications, which is both inconvenient and costly.

Accordingly, it is an object of the present invention to provide an improved switch especially suitable for security alarm systems which is relatively simple in construction, easy to use and is readily adaptable to a variety of mounting positions.

It is a further object of this invention to provide such a switch which is economical to produce, durable and reliable in operation.

It is a more particular object of the present invention to provide such a switch which is adaptable to different methods of activation and which enables facile conversion thereof to either a latching- or momentary-type switch.

Certain of the foregoing and related objects are readily attained in an alarm switch which includes a hollow casing having a keyhole and a finger opening formed therein at least one electrical switch mounted in the casing having a spring-loaded actuation pin, and a reversible cam pivotably mounted in the casing for movement between an engaged position, in which it is held in biased engagement with the switch pin so as to maintain the pin in a retracted biased state, and a release position, in which it is disposed in a substantially non-biased engaging position with the pin so as to permit extension of the pin and triggering of an alarm signal by the electrical switch. The cam has a bevelled end defining a bevelled end face and is removably mounted in the casing to permit mounting thereof with its bevelled end face either directed generally towards, or away from, the actuation pin. The switch also includes a reversible block removably mounted in the casing, having a finger depression formed in one face thereof which is at least partially alignable with the finger opening of the casing and a keyway formed in a first side face thereof which is alignable with the keyhole of the casing. The block also has at least one latch lug extending outwardly therefrom which, in a first position of the block, maintains the cam in biased engagement with the switch pin and, in a second position of the block, releases the cam to permit movement thereof to the release position thereof so as to thereby activate the alarm.

In a preferred embodiment of the invention, the block is slidably mounted in the casing for movement between the first and second positions thereof and is spring-loaded so as to urge the block into the first position thereof. It is also advantageous to employ a second electrical switch mounted adjacent to the first switch.

In a further embodiment of the invention, there is provided a key which is insertable in the keyhole and the keyway. The cam is pivotably mounted in the casing such that it is at least partially alignable with the keyway in the release position thereof so that, following insertion, the key may contact the cam and urge it back to its first position. Most desirably, the block is generally rectangular and has two spaced-apart channel walls formed in a first side face thereof defining a first U-shaped channel which, in turn, defines the keyway. The block also preferably has a pair of latch lugs each of which is aligned with the projects outwardly beyond one of the channel walls.

Most advantageously, the casing comprises a generally box-shaped housing having a removable top plate and the housing has an internal abutment formed on a lateral wall thereof disposed generally adjacent to the cam, when in the release position thereof. In one particular embodiment of the invention, the key consists of a shaft having a pointed end and the keyhole is formed in the top plate and is aligned so as to guide the pointed end of the key, following insertion in the keyhole, between the lateral wall of the casing on which the abutment is formed and the cam, when the cam is disposed in the second position thereof, so as to wedge them apart and to urge the cam back to the first position thereof. The cam is desirably provided with a bevelled side edge so as to facilitate the insertion of the key between the casing sidewall and the cam. In addition, it is further preferable that the top plate be coupled to the rear of a wall plate which is provided with an opening in alignment with the finger opening of the casing.

In yet another preferred embodiment of the invention, the pointed end of the key is notched so as to permit frictional engagement thereof with the internal abutment, in which position the pointed end engages the cam and maintains the same in the first position thereof. The key is further provided with a handle to which a trip wire is secured. Furthermore, the block is provided with a second U-shaped channel formed in a second side face thereof adjoining the first side face and additionally includes a spring-loaded locking bar slidably mounted in the second U-shaped channel which serves to block the keyway upon removal of the key. In this embodiment, the block is mounted in the housing with the one face thereof containing the finger depression being positioned face down.

Other objects and features of the present invention will become apparent from the following detailed description when taken in connection with the accompanying drawings which disclose several embodiments of the invention. It is to be understood that the drawings are designed for the purpose of illustration only, and are not intended as a definition of the limits of the invention.

In the drawings, wherein similar reference characters denote similar elements throughout the several views:

FIG. 5 is an exploded, perspective view of the switch shown in FIG. 1, with the cover plate omitted;

FIG. 6 is a plan view of the switch taken along line 6—6 of FIG. 1, with the cover plate removed showing the switch components in a normal, deactivated position;

FIG. 7 is a plan view comparable to that of FIG. 6, but showing the switch components in an alarm activating momentary position;

FIG. 8 is a plan view comparable to that of FIGS. 5 and 6, but showing the key fully inserted to convert the switch into a two stage momentary switch;

Figure 3:
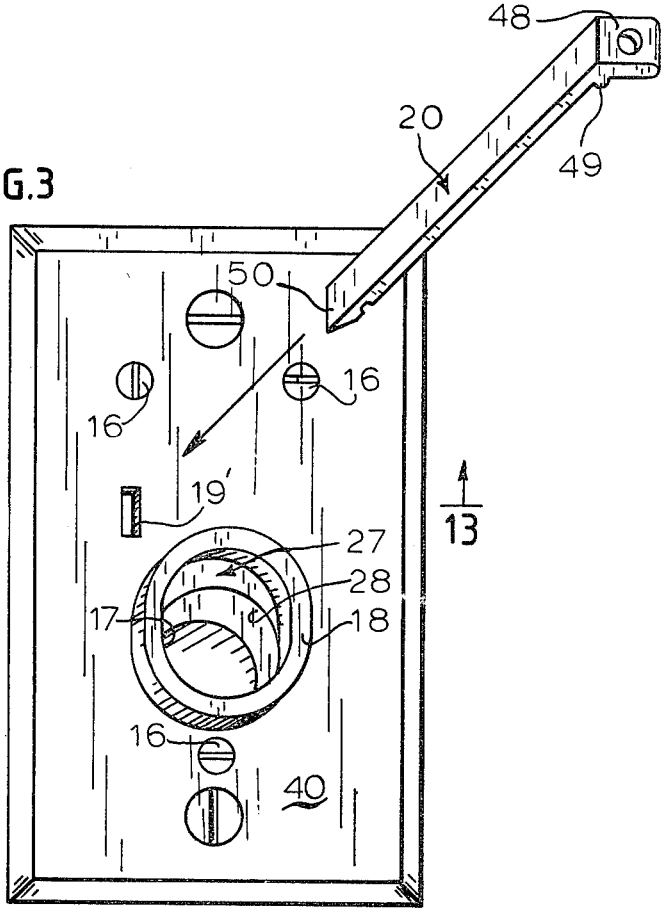
FIG. 3 is a perspective view showing an alternate embodiment of the inventive switch which is incorporated in a switch plate for a recessed mounting, further showing the key being directed into a differently positioned reset keyhole.
Figure 4:
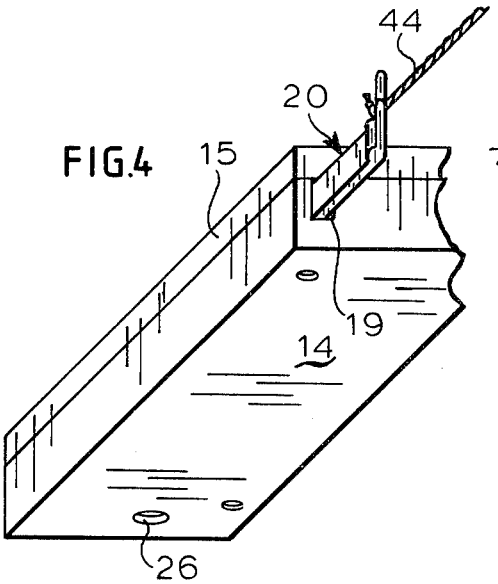
FIG. 4 is a fragmentarily-illustrated, perspective view of a further embodiment of the invention which is activated by a trip wire.
Figure 13:
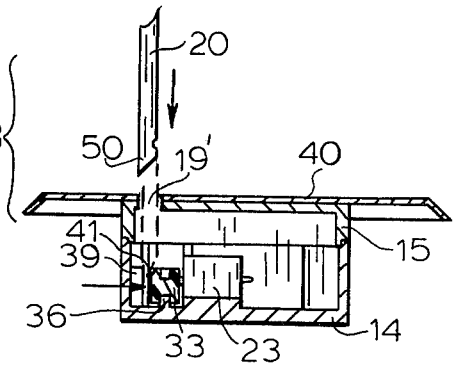
Figure 11:
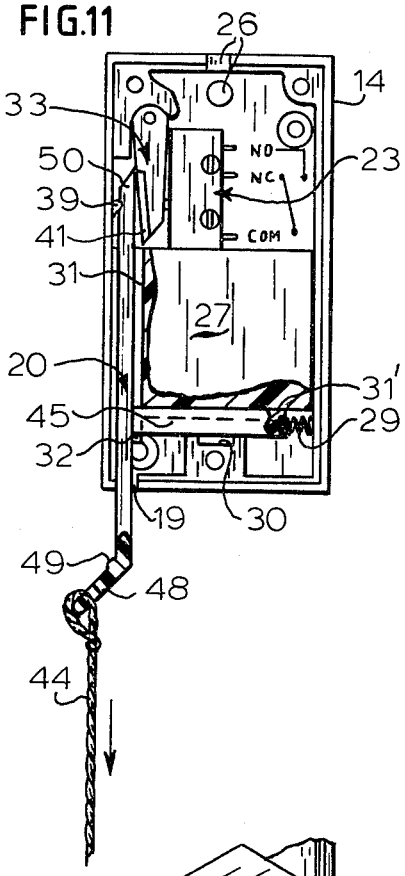
Figure 12:
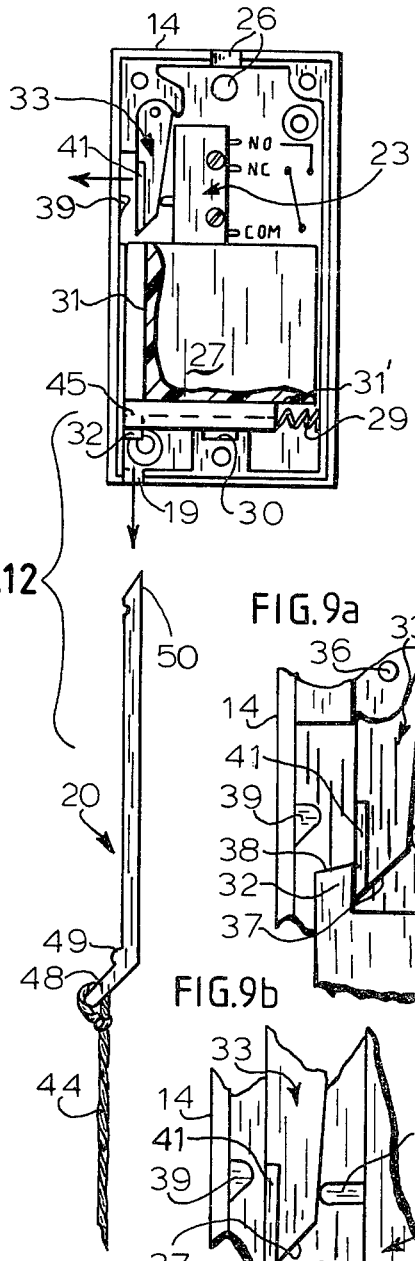
Figure 10:
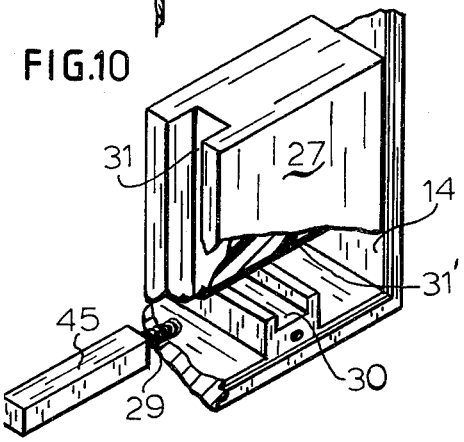
Figure 9A:
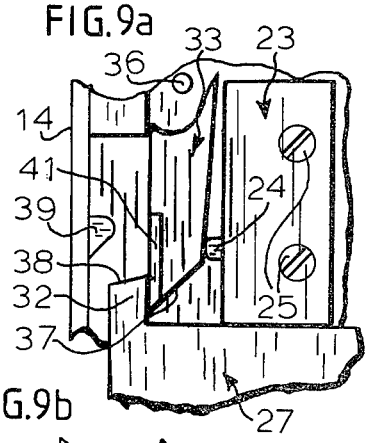
Figure 9B:
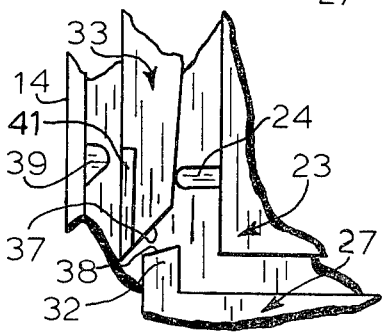

FIGS. 9*a* and 9*b* are enlarged, fragmentarily-illustrated plan views of the switch comparable with that of FIGS. 6 and 7, respectively, but with the cam reversed so as to convert the switch from a momentary to a latching switch;

FIG. 10 is an enlarged, fragmentarily-illustrated perspective view showing the internal arrangement of certain switch components for the trip wire embodiment shown in FIG. 4;

FIG. 11 is a plan view of the trip wire activated embodiment shown in FIG. 4, with the cover plate removed and prior to activation;

FIG. 12 is a plan view comparable to that of FIG. 11 but following activation; and FIG. 13 is a transversed sectional view taken along line 13—13 of FIG. 3.

Figure 1:
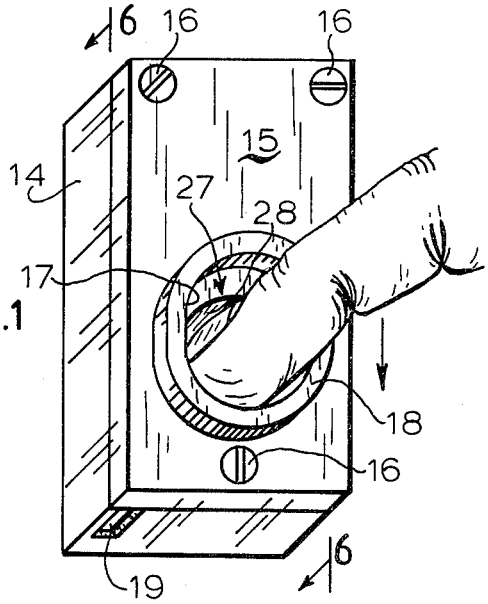
FIG. 1 is a perspective view of a novel alarm switch embodying the present invention, further showing manual activation thereof.
Figure 2:
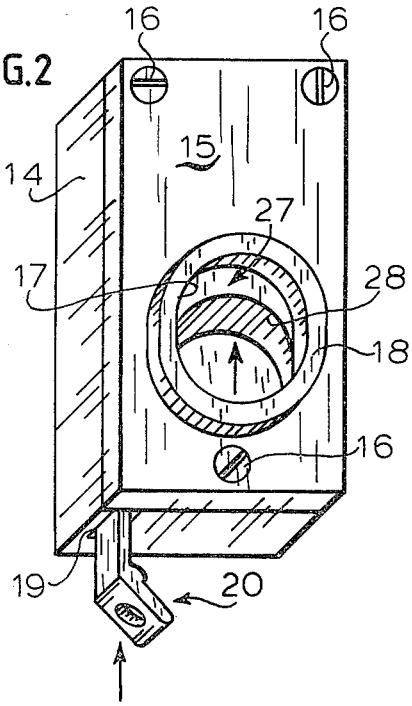
FIG. 2 is a perspective view comparable to that of FIG. 1, but showing deactivation and resetting of the switch by means of a reset key, inserted in a reset keyhole.

Turning now in detail to the drawings and, in particular, FIGS. 1 and 2, therein illustrated is a novel switch for an emergency or security alarm system embodying the present invention which includes a generally rectangular box-shaped casing 14, preferably made of plastic. Casing 14 has a removable, rectangular cover or top plate 15, also preferably made of plastic, secured thereto by three screws 16. Top plate 15 has a generally oval-shaped finger hole 17 formed therethrough defined by a raised, oval-shaped border 18. Casing 14 also has a reset keyhole 19 formed in the lower sidewall thereof for insertion of a reset key 20; the operation of which will be discussed in greater detail hereinafter.

As shown best in FIG. 5, rectangular casing 14 has a raised mounting base or plate 21 having an abutment stop 22, on which is seated a pair of conventional transfer switches 23 having spring-loaded actuation or trigger pins 24; one such Microswitch may be used but two Microswitches are preferred so as to provide two isolated circuits, one for triggering a local alarm and the other for triggering a distant alarm in a central office, such as a police station or in the office of a private security firm. Switches 23 are secured to mounting plate 21 by means of a pair of screws 25. Casing 14 is also provided with a pair of holes 26 for the electrical wires (not shown) leading to switches 23. An electrical wiring diagram is imprinted on the base wall of casing 14 to assist the installer in connecting the wire leads to the terminals of switches 23 (NO, NC and COM being abbreviations for "normally open", "normally closed" and "common", respectively).

As also shown in FIGS. 5–8, a preferably plastic, generally rectangular block 27 containing a generally frustoconically-shaped finger hole or depression 28 formed in the top face thereof is slidably mounted in casing 10 for at least partial registration with finger hole 17 of the top plate 15. Block 27 may be held in a biased manner against one end of switches 23 by means of a coil spring 29, one end of which rests in a U-shaped channel 30 formed on a lateral end wall of casing 14 and the other end of which resides in a bore formed in the end of block 27 (see FIGS. 6–8). Block 27 is provided with a pair of U-shaped channels 31, 31′ on adjoining lateral sides thereof and is further provided with a pair of channel sidewall extensions or lugs 32 associated with channel 31 which are intended to serve as a latch, as also described in greater detail hereinafter.

Also mounted in casing 14 is a pivotably-mounted, removable and reversible wedge-shaped cam 33 which is disposed for cooperation with the trigger pins 24 of switches 23, as well as the latching lugs 32 of block 27. Cam 33 has a pivot axis end outwardly supported for limited pivotal movement in casing 14 by means of an arcuately-configured, lateral casing support surface 34. Cam 33 has a pair of pivot depressions 35 formed in the top and bottom faces of the pivot axis end thereof (compare FIGS. 6 and 11), one of which is intended to be pivotably retained on a complimentary dimensioned and shaped pivot hub or boss 36 extending upwardly from the base wall of casing 14 (see FIG. 8). The relatively wide pivot axis end of cam 33 tapers to a relatively narrow trigger pin-engaging end which is bevelled at an angle of about 30°, so as to define a bevelled end face 37 which either faces away from switches 23 (FIGS. 6–8) or towards the same (FIGS. 9*a*, 9*b* and 11–13), in the former position of which it converts the switch into a momentary switch and in the latter position of which it converts the same into a latching switch.

In either case, switches 23, block 27 and cam 33 are so dimensioned and positioned in casing 14 such that in a normal, deactivated state, latching lugs 32 of block 27, under the biasing action of coil spring 29, force one of the side faces of the trigger pin-engaging end of cam 33 against spring-loaded pins 24 of switches 23 so as to maintain them in a retracted, non-alarm state (FIGS. 6 and 9*a*). However, upon manual movement of slide block 27 against the force of spring 29 (this being effcted by inserting one's finger in the finger hole 17 and finger depression 28 and pushing block 27 in the direction of the arrows shown in FIGS. 1 and 6), latching lugs 32 are moved to a release position. As a result, there is no force acting on cam 33 and the spring- or otherwise outwardly-biased trigger pins 24 are also released, thereby triggering an alarm signal.

As a result of the mounting of cam 33 with its bevelled face 37 facing away from switches 23 and towards latching lugs 32, the switch is a momentary-type switch. Once the person releases the force of his finger from finger depression 28, slide block 27 under the action of spring 29 will be forced back to its original position shown in FIG. 6. This is permitted by the bevelled end face 37 of cam 33 which allows the also slighted bevelled (about 10°) leading edge 38 of lugs 32 to slide therealong, causing cam 33 to be forced once again against pins 24. A key 20 is provided which comprises a long shaft having a handle 48 at one end, which is provided with a strengthening or reinforcing knob 49, and a tapered, notched pointed end 50 at the opposite end thereof. If desired, key 20 may be inserted into keyhole 19 and through the keyway defined by slot 30 until it also abuts cam 33 guided partially by and finally being held in position by a casing wall internal abutment 39 (see FIG. 11); by using key 20, consequently, a two-stage momentary switch is provided, with activation of the alarm requiring (1) removal of key 20 and (2) depression of slide block 27.

If cam 33 was reversed such that bevelled end face 37 faced towards switches 23 and away from lugs 32 (see FIGS. 9*a* and 9*b*), the switch would function as a latching-type switch. In this case, following depression of slide block 27 and upon removal of the operator's finger from finger depression 28, slide block 27 cannot return to its original position because the leading edge of bevelled surface 37 rests on the leading bevelled face 38 of lugs 32. In addition, any upward movement of lugs 32 would cause further outward displacement of cam 33 away from pins 24 due to its outwardly bevelled face 38. As a result, in this embodiment the switch can only be reset by means of reset key 20. Key 20 is inserted through keyhole 19 and the keyway defined by channel 31 and, guided partially by wall abutment 39, it pushes cam 33 off the leading edge of lugs 32 and towards switches 23. Consequently, slide block 27 may return to its original position, under the biasing action of spring 29, so as to force cam 33 against pins 24 and cause retraction thereof. Here too, key 20 may be reversed 180° and re-inserted (see FIG. 11), so as to afford a two-stage latching switch, with activation of the alarm again requiring (1) removal of key 20 and (2) depression of slide block 27.

FIGS. 3 and 13 illustrate an alternate embodiment of the invention which permits the switch (with cam 33 in either a latching or non-latching mode) to be mounted in a wall or switch plate 40 provided with a complementarilly-configured aperture for receipt therein of raised rim 18. In this embodiment, the construction of the switch is the same as is shown in the previously discussed figures with the exception of the provision of keyhole 19' passing through cover plate 15, as well as wall plate 40, so as to permit insertion of key 20 in a downward direction, as shown in FIG. 13 between cam 33 and the interior of casing 14, in the area between abutment 39 and block 27. Cam 33 is provided with a bevelled side edge 41 so as to facilitate insertion of the tapered end 50 of key 20 between cam 33 and the interior wall of casing 14 in a wedging action so as to cause cam 33 to be pushed off end face 38 of lugs 32 and towards switches 23. This, in turn, allows slide block 27 to return to its original position and to deactivate and reset the alarm, if the latching configuration of cam 33 was desired.

FIGS. 4 and 10–12 illustrate a further embodiment of the invention which provides for trip wire activation of the switch. In this case, slide block 27 is flipped over such that latch lugs 32 are disposed adjacent to keyhole 19. Key 20 is inserted in keyhole 19 and keyway 31 of block 27 until it abuts cam 33 and forces it against pins 24. Key 20 is reversed so that its notched portion engages wall abutment 39 (see FIG. 11) so as to allow for a certain amount of tension in the trip wire 44 which is attached to handle 48 of key 20.

As shown in FIG. 12, upon pulling of trip wire 44, key 20 is removed from the switch, releasing cam 33 and pins 24 to trigger the alarm. In order to prevent one from simply replacing key 20 to turn off alarm, an elongated, rectangular locking bar 45 is provided which is slidably mounted in channel 31' and which is spring-loaded by means of coil spring 29 (in this embodiment slide block 27 is not spring-loaded); locking bar 45 may be provided with an end wall bore (not shown) for partial receipt therein of spring 29. As a result, as soon as key 20 is removed, bar 45 slides over to obstruct and close off the keyway, thereby preventing reinsertion of key 20 without the time-consuming removal of screws 16.

While only several embodiments of the present invention have been shown and described, it will be obvious that many changes and modifications may be made thereunto, without departing from the spirit and scope of the invention.

What is claimed is:

1. An alarm switch comprising:

a hollow casing having a keyhole and a finger opening formed therein;

at least one electrical switch mounted in said casing having a spring-loaded actuation pin;

a reversible cam pivotably mounted in said casing for movement between an engaged position, in which it is held in biased engagement with said switch pin so as to maintain said pin in a retracted biased state, and a release position, in which it is disposed in a substantially non-biased engaging position with said pin so as to permit extension of said pin and triggering of an alarm signal by said electrical switch, said cam having a bevelled end defining a bevelled end face and being removably mounted in said casing to permit mounting thereof with said bevelled end face either directed generally towards or away from said actuation pin; and a reversible block removably mounted in said casing, said block having a finger depression formed in one face thereof which is at least partially alignable with said finger opening of said casing and a keyway formed in a side face thereof which is alignable with said keyhole of said casing, said block also having at least one latch lug extending outwardly therefrom which, in a first position of said block, maintains said cam in biased engagement with said switch pin and, in a second position of said block, releases said cam to permit movement thereof, to said release position thereof so as to thereby activate said alarm.

2. The alarm switch according to claim 1, wherein said block is slidably mounted in said casing for movement between said first and second positions thereof and is spring-loaded so as to urge said block into said first position thereof.

3. The alarm switch according to claim 2, additionally including a key which is insertable in said keyhole and said keyway and wherein said cam is pivotably mounted in said casing such that it is at least partially alignable with said keyway in said release position thereof so that, following insertion, said key may contact said cam and urge it back to its first position.

4. The alarm switch according to claim 3, wherein said block is generally rectangular and has two spaced-apart channel walls formed in a first side face thereof defining a U-shaped channel which, in turn, defines said keyway, said block also having a pair of said latch lugs, each of which is aligned with the projects outwardly beyond one of said channel walls.

5. The alarm switch according to claim 1, additionally including a second electrical mounted adjacent to said at least one switch.

6. The alarm switch according to claim 1, wherein said casing comprises a generally box-shaped housing having a removable top plate and wherein said housing has an internal abutment formed on a lateral sidewall thereof disposed generally adjacent to said cam, when in said release position thereof.

7. The alarm switch according to claim 6, wherein said key comprises a shaft having a pointed end and wherein said keyhole is formed in said top plate and is aligned so as to guide the pointed end of said key, following insertion in said keyhole, between said sidewall ad said cam, when said cam is disposed in said second position thereof, so as to wedge them apart and to urge said cam back to said first position thereof.

8. The alarm switch according to claim 7, wherein said cam is provided with a bevelled side edge so as to facilitate the insertion of said key between said sidewall and said cam.

9. The alarm switch according to claim 7, wherein said top plate is coupled to the rear of a wall plate which is provided with an opening in alignment with said finger opening of said casing.

10. The alarm switch acording to claim 6, wherein said key has a pointed end which is notched so as to permit frictional engagement thereof with said internal abutment, in which position said pointed end engages said cam and maintains the same in said first position thereof and wherein said key has a handle to which a trip wire is secured.

11. The alarm switch according to claim 10, wherein said block has a second U-shaped channel formed in a second side face thereof adjoining said first side face and additionally includes a spring-loaded locking bar slidably mounted in said second U-shaped channel, said block being mounted in said casing with said one face thereof containing said finger depression being positioned face down in said housing, said locking bar serving to block said keyway upon removal of said key.

* * * * *